US012545381B2

(12) United States Patent
Woo et al.

(10) Patent No.: US 12,545,381 B2
(45) Date of Patent: Feb. 10, 2026

(54) WEARABLE DEVICE FOR SCUBA DIVING

(71) Applicant: Bum Je Woo, Seongnam-si (KR)

(72) Inventors: Bum Je Woo, Seongnam-si (KR); Ji Woong Woo, Seongnam-si (KR)

( * ) Notice: Subject to any disclaimer, the term of this patent is extended or adjusted under 35 U.S.C. 154(b) by 0 days.

(21) Appl. No.: 18/746,500

(22) Filed: Jun. 18, 2024

(65) Prior Publication Data

US 2024/0425159 A1 Dec. 26, 2024

(30) Foreign Application Priority Data

Jun. 20, 2023 (KR) ..... 10-2023-0079195

(51) Int. Cl.

| | |
|---|---|
| ***B63C 11/12*** | (2006.01) |
| ***B63C 11/26*** | (2006.01) |
| *B63C 11/02* | (2006.01) |

(52) U.S. Cl.

CPC ..... *B63C 11/12* (2013.01); *B63C 11/26* (2013.01); *B63C 2011/021* (2013.01); *B63C 2011/121* (2013.01)

(58) Field of Classification Search

CPC ... B63C 11/12; B63C 11/26; B63C 2011/021; B63C 2011/121; B63C 11/02; G02B 27/017

See application file for complete search history.

(56) References Cited

U.S. PATENT DOCUMENTS

| | | | | |
|---|---|---|---|---|
| 6,977,671 | B1 * | 12/2005 | Kitson | H04N 5/772 348/81 |
| 7,310,063 | B1 * | 12/2007 | Brown | B63C 11/26 342/357.75 |
| 2010/0302233 | A1 * | 12/2010 | Holland | G06T 19/00 707/E17.018 |
| 2018/0197503 | A1 * | 7/2018 | Sasaki | G09G 3/002 |
| 2020/0132463 | A1 * | 4/2020 | Gauthier | G01C 21/20 |
| 2023/0182875 | A1 * | 6/2023 | Kleinigger | B63C 11/26 116/26 |

FOREIGN PATENT DOCUMENTS

| | | | | |
|---|---|---|---|---|
| CN | 113608355 | A * | 11/2021 | G01S 13/867 |
| JP | 5417656 | B2 | 2/2014 | |
| KR | 10-2015-0001387 | A | 1/2015 | |
| KR | 10-2253584 | B1 | 5/2021 | |
| KR | 10-2021-0084586 | A | 7/2021 | |
| KR | 10-2021-0101915 | A | 8/2021 | |
| KR | 10-2022-0074039 | A | 6/2022 | |
| KR | 10-2022-0104918 | A | 7/2022 | |
| KR | 10-2023-0030790 | A | 3/2023 | |

OTHER PUBLICATIONS

The Notice of Submission of Opinions for Korean Patent Application No. 10-2023-0079195, dated Jan. 14, 2025.

* cited by examiner

*Primary Examiner* — Towfiq Elahi

(57) ABSTRACT

Proposed is a wearable device for scuba diving that is worn on the user's body when scuba diving. The device is intended to allow users to effectively enjoy the underwater environments. The device includes a mask part worn on a user's head, and a wearable part worn on a user's waist or arm.

11 Claims, 4 Drawing Sheets

WEARABLE DEVICE FOR SCUBA DIVING

CROSS-REFERENCE TO RELATED APPLICATION

This application claims priority to Korean Patent Application No. 10-2023-0079195, filed in the Korean Intellectual Property Office on Jun. 20, 2023, which is hereby incorporated by reference in its entireties.

TECHNICAL FIELD

The present disclosure relates to a wearable device for scuba diving that is worn on the user's body when scuba diving.

BACKGROUND ART

Scuba diving refers to underwater diving whereby divers wear a mask, an underwater respirator, and a buoyancy control vest, etc.

To effectively enjoy scuba diving, i) visibility must be perfect, ii) the current status of a scuba diver must be known, iii) whether the underwater environment is safe must be checked in real time, iv) communication with other scuba divers nearby must be smooth, and v) a scuba diver must be able to stay underwater for a long time.

In the case of conventional wearable devices for scuba diving, only some of the above-mentioned conditions were partially satisfied. In order to perfectly meet these conditions, various types of sensors or components are needed to perform individual functions, and a large amount of power is required to drive the sensors or components. However, to date, a system that can effectively supply large amounts of power has not been developed.

Moreover, to enjoy scuba diving effectively, a mask part of a wearable device for scuba diving needs to be equipped with many components as well as a power supply part. In this case, the weight of the mask part becomes heavy, which causes problems in underwater activities.

DOCUMENTS OF RELATED ART

Patent Documents (Patent Document 1) Korean Patent No. 10-2253584

DISCLOSURE OF INVENTION

Technical Problem

Accordingly, the present disclosure has been made keeping in mind the above problems occurring in the related art, and the present disclosure is intended to provide a wearable device for scuba diving that allows a user to effectively enjoy the underwater environment.

Solution to Problem

A wearable device for scuba diving according to an aspect of the present disclosure includes: a mask part worn on a user's head; and a wearable part worn on a user's waist or arm, wherein the mask part may include: a mask part body; a glass faceplate provided at a front of the mask part body; a camera configured to capture underwater environments; and a projector installed inside the mask part body to output images or image to the glass faceplate, and the wearable part may include: a wearable part body; and a battery provided in the wearable part body and supplying power to the mask part.

In addition, the device may further include a cable configured to connect the wearable part and the mask part to supply power from the battery to the mask part.

In addition, the wearable part may further include an ultrasonic transmitter that is connected to the battery and transmits power via ultrasonic waves, and the mask part may further include an ultrasonic receiver that receives the power transmitted via ultrasonic waves.

In addition, the mask part may further include radar installed on top of the glass faceplate, and the projector may output images captured by the camera or an image scanned by the radar to the glass faceplate.

In addition, the wearable part may further include a controller configured to receive the images captured by the camera or the image scanned by the radar, correct the images or the image, and transmit the corrected images or image to the projector.

In addition, the wearable part may further include a controller configured to control the camera and the projector.

In addition, the mask part may further include an LED light provided on each side of the mask part body.

In addition, the mask part may further include a humidity sensor that measures an inflow of water or moisture into an interior of the glass faceplate, and the wearable part may further include a floating part provided on the wearable part body to control buoyancy; and a controller that raises a user out of water by increasing the buoyancy of the floating part when water is measured, by the pressure sensor, to flow into the interior of the glass faceplate.

In addition, the controller may operate a navigation system that outputs an optimal route to a ship connected by wireless communication to the glass faceplate by means of the projector when the water is measured, by the pressure sensor, to flow into the interior of the glass faceplate.

In addition, the device may further include a communication device provided in the mask part or the wearable part to communicate wirelessly with a ship or another user, and wherein the wearable part may further include a controller that outputs a warning signal to the glass faceplate by means of the projector when a distance from the ship or another user increases.

In addition, the mask part may further include a gravity sensor provided on the mask part body to detect a direction of gravity, the wearable part may further include a controller that calculates up and down directions underwater based on the direction of gravity measured by the gravity sensor, and the projector may output the calculated up and down directions underwater to the glass faceplate.

In addition, the mask part may further include a geomagnetic field sensor that is provided on the mask part body and measures geomagnetic field, wherein the controller may calculate a user's orientation underwater on the basis of the geomagnetic field measured by the geomagnetic field sensor, and the projector may output the calculated user's orientation underwater to the glass faceplate.

In addition, the mask part may further include an acceleration sensor provided on the mask part body to detect changes in speed indicated by the mask part; and a gyro sensor provided on the mask part body to recognize a tilt of the mask part, the wearable part may further include a controller that calculates a user's location underwater on the basis of data obtained by the acceleration sensor and the gyro sensor and transmits the calculated user's location to the projector, and the projector may output the calculated user's location underwater to the glass faceplate.

Advantageous Effects of Invention

According to the wearable device for scuba diving of the present disclosure as discussed above, the following effects are achieved.

Since a battery and a controller are provided on a wearable part, a mask part can be made lighter and more compact. Therefore, the user's underwater activities can be performed smoothly.

As a buoyancy variable floating part is controlled by the controller, when remaining oxygen level in a tank is low or when water flows into a glass faceplate of the mask part, a user can be automatically raised from the water.

A camera and radar enable visibility and understanding of surrounding terrain even in turbid underwater environments.

When dangerous elements such as a reef or a shark is discovered in the surrounding environment, this can be notified to the user through a head-up display (HUD).

When the user becomes distant from a ship and other users, the user can be notified through the HUD.

MODE FOR THE INVENTION

Figure 1:
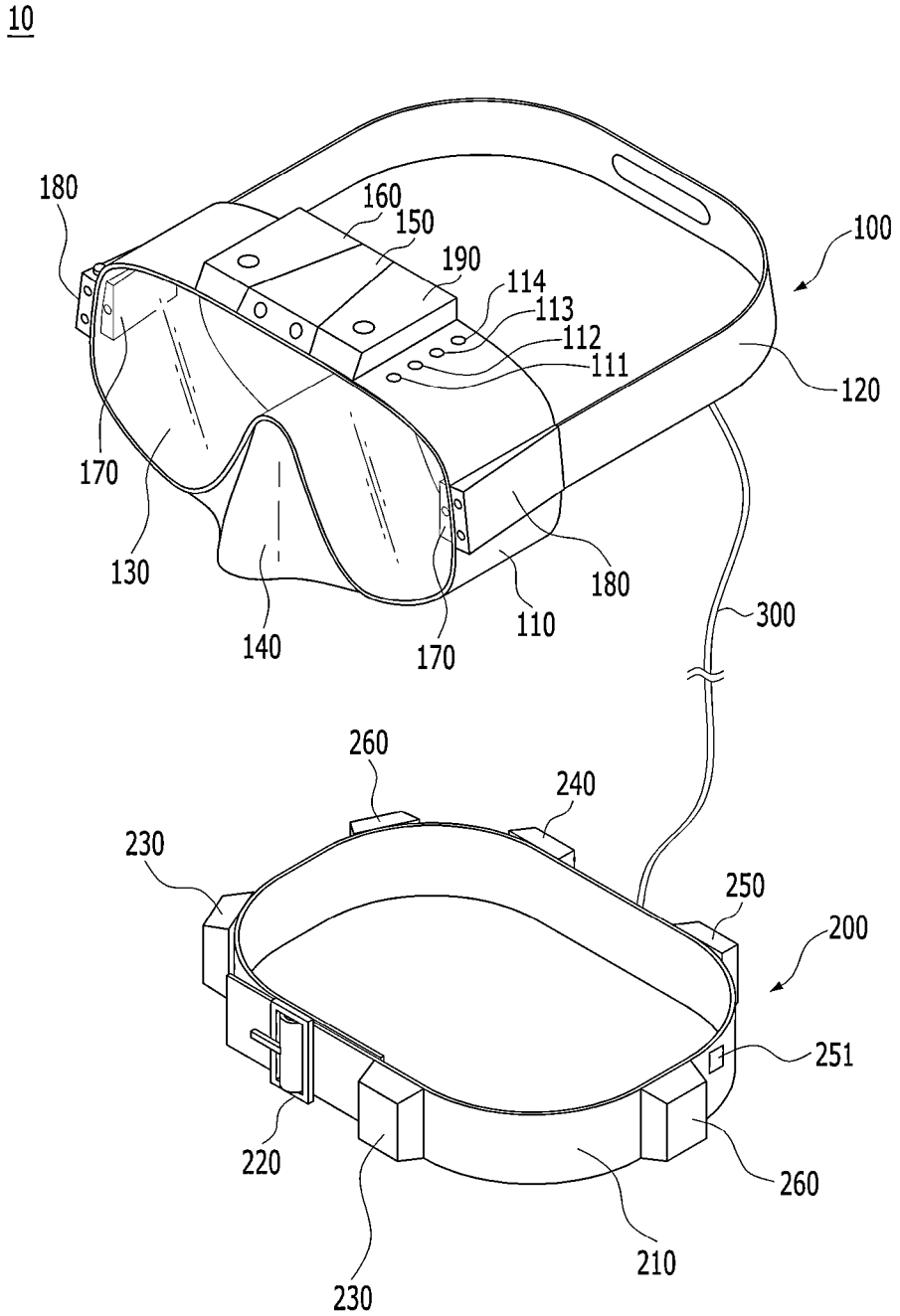
FIG. 1 is a perspective view of a wearable device for scuba diving of the present disclosure.

Contents of the description below merely exemplify the principle of the present disclosure. Therefore, those of ordinary skill in the art may implement the theory of the present disclosure and invent various apparatuses which are included within the concept and the scope of the present disclosure even though it is not clearly explained or illustrated in the description. Furthermore, in principle, all the conditional terms and embodiments listed in this description are clearly intended for the purpose of understanding the concept of the present disclosure, and one should understand that the present disclosure is not limited to the exemplary embodiments and the conditions.

The above-described objectives, features, and advantages will be more apparent through the following detailed description related to the accompanying drawings, and thus those of ordinary skill in the art may easily implement the technical spirit of the present disclosure.

The embodiments of the present disclosure are described with reference to cross-sectional views and/or perspective views which schematically illustrate ideal embodiments of the present disclosure. The thicknesses of films and regions shown in these drawings are exaggerated for effective explanation of technical content. The form of the illustration may be changed depending on manufacturing technology and/or tolerances. In addition, the number of metal moldings shown in the drawings is illustrative and only a portion is shown in the drawings. Accordingly, the embodiments of the present disclosure are not limited to the specific form shown, but also include changes in form produced according to the manufacturing process. The technical terms used herein is for the purpose of describing particular embodiments only and is not intended to be limiting. The singular forms are intended to include the plural forms as well, unless the context clearly indicates otherwise. It will be further understood that the terms "comprise", "include", "have", etc., when used in this specification, specify the presence of stated features, integers, steps, operations, elements, components, and/or combinations thereof but do not preclude the presence or addition of one or more other features, integers, steps, operations, elements, components, and/or combinations thereof.

Reference will now be made in greater detail to exemplary embodiments of the present disclosure, examples of which are illustrated in the accompanying drawings. In describing various embodiments below, the same reference numerals will be used throughout different embodiments and the description to refer to the same or like elements or parts. In addition, the configuration and operation already described in other embodiments will be omitted for convenience.

A wearable device 10 for scuba diving of the present disclosure is equipment for enjoying the underwater environment through scuba diving.

To effectively enjoy scuba diving, i) visibility must be perfect, ii) the current status of a scuba diver must be known, iii) whether the underwater environment is safe must be checked in real time, iv) communication with other scuba divers nearby must be smooth, and v) a scuba diver must be able to stay underwater for a long time.

First, in order to ensure perfect visual field of view, the wearable device 10 for scuba diving of the present disclosure displays images captured by a camera 150 on the inside of a glass faceplate 130, and automatically adjusts the focus of the displayed image, allowing users without glasses to see the external environment clearly. In addition, by scanning the external environment through radar, etc., the terrain may be easily identified even in a turbid underwater environment. Furthermore, visibility may be secured even in dark deep waters by means of an LED light 180, and images captured by the camera 150 are corrected and output, allowing visibility even in turbid environments where visibility is limited.

To determine the current status of a user who scuba dives, the wearable device 10 for scuba diving of the present disclosure may obtain information such as the user's diving depth, direction, remaining oxygen, water temperature, and diving time from a gravity sensor 111, an acceleration sensor 112, a gyro sensor 113, a geomagnetic field sensor 114, an oxygen sensor, a position sensor, a temperature sensor, a timer, etc., and output the obtained information to the glass faceplate 130 by using a projector 170 so that the user may easily check the information. In addition, the device 10 may output the user's current location to a mini-map 132 by means of a mask part communication device 190, a wearable part communication device 250, the projector 170, and the glass faceplate 130, and may determine the up and down directions underwater using a three-dimensional (3D) direction chart 131.

To ensure that the underwater environment is safe in real time, the wearable device 10 for scuba diving of the present disclosure may recognize the surrounding environment through the camera 150 and radar 160, and may check the recognized information with the mini-map 132.

To facilitate communication with other users who scuba dive together in the vicinity, the wearable device 10 for scuba diving of the present disclosure may communicate with other users through the mask part communication device 190 and the wearable part communication device 250. Additionally, it is possible to select and communicate with any user among several users displayed on the HUD.

To make it possible to stay underwater for long periods of time, the wearable device 10 for scuba diving of the present disclosure achieves weight reduction of a mask part 100 by equipping a wearable part 200 with a high-capacity battery 230, so that a user may move freely underwater and the device 10 may be used for a long time.

Hereinafter, the wearable device 10 for scuba diving of the present disclosure will be described in more detail with reference to FIGS. 1 to 3.

FIG. 1 is a perspective view of a wearable device for scuba diving of the present disclosure; FIG. 2 is a perspective view of a mask part of FIG. 1; FIG. 3 shows users wearing a wearable device for scuba diving of the present disclosure communicating with surrounding users and ships; and FIG. 4 shows a HUD screen displayed on a glass faceplate of a wearable device for scuba diving of the present disclosure.

Figure 2:
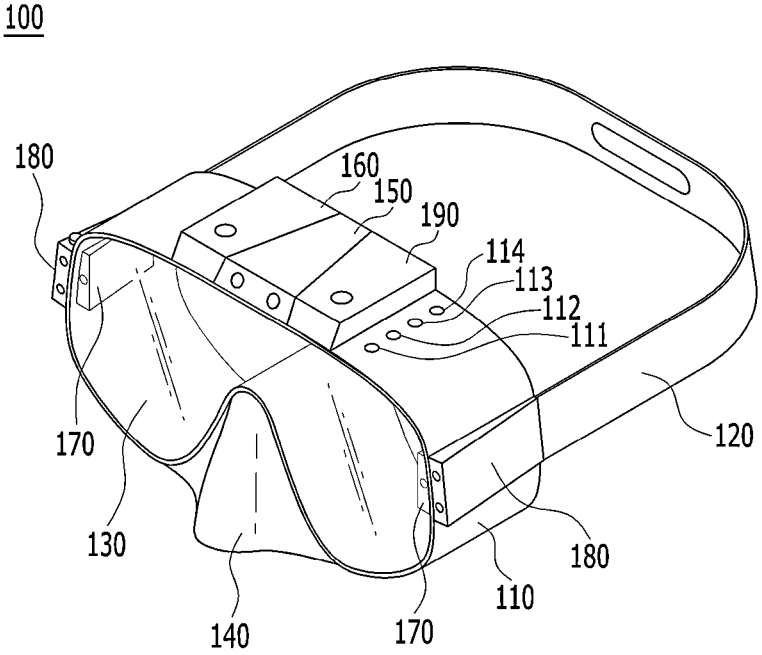
FIG. 2 is a perspective view of a mask part of FIG. 1.
Figure 3:
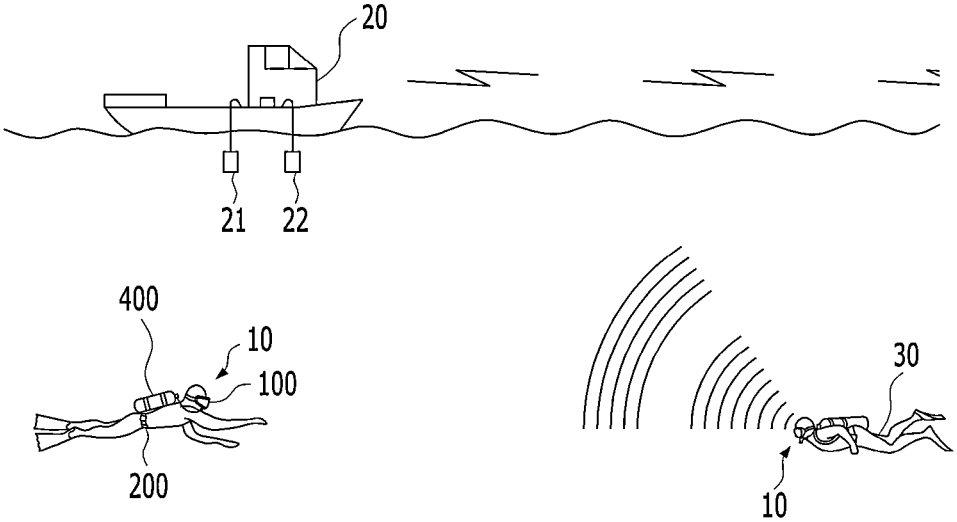
FIG. 3 shows users wearing a wearable device for scuba diving of the present disclosure communicating with surrounding users and a ship.
Figure 4:
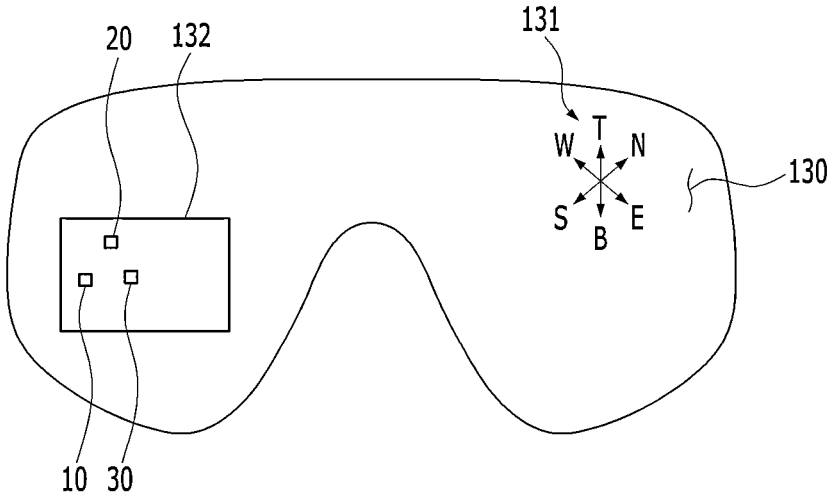
FIG. 4 shows a HUD screen displayed on a glass faceplate of a wearable device for scuba diving of the present disclosure.

As shown in FIGS. 1 to 3, the wearable device 10 for scuba diving of the present disclosure may include the mask part 100 worn on the user's head, the wearable part 200 worn on the user's waist or arm, and a cable 300 connecting the mask part 100 and the wearable part 200.

The mask part 100 is worn on the user's head and functions to prevent water from entering the user's eyes while underwater.

The mask part 100 may include: a mask part body 110; a hair band 120 provided at the rear of the mask part body 110 and surrounding the user's head; the glass faceplate 130 provided at the front of the mask part body 110 to prevent water from entering the user's eyes; a nose cover 140 that is provided at the lower center of the glass faceplate 130 and prevents water from entering the user's nose; the camera 150 that is installed on the upper part of the glass faceplate 130 and captures underwater environments; the radar 160 installed on top of the glass faceplate 130; the projector 170 that is installed inside the mask part body 110 to be located behind the glass faceplate 130 and outputs images or an image to the glass faceplate 130; and the LED light 180 provided on each side of the mask part body 110.

The mask part body 110 functions to connect the glass faceplate 130 and the hair band 120, and covers the user's head when the user wears the mask part 100.

The hair band 120 is provided at the rear of the mask part body 110 and wraps around the back of the user's head to secure the mask part 100 to the user's head.

The glass faceplate 130 is provided in front of the mask part body 110 and covers the upper front of the user's face, and thus functions to prevent water from entering the user's eyes while underwater.

The glass faceplate 130 may be equipped with a display such as an LED, and images captured by the camera 150 may be output to the glass faceplate 130 in real time. That is, in normal times, the glass faceplate 130 is maintained in a transparent state so that the user may see the external environment through the glass faceplate 130, whereas when the display mode is operated under the control of a controller 240, the images captured by the camera 150 are output inside the glass faceplate 130, allowing the user to view the external environment by means of the camera 150.

The glass faceplate 130 may be equipped with an autofocus feature. The autofocus feature takes the user's vision into account.

The autofocus feature may be implemented by adjusting the focus of the image output into the glass faceplate 130 by means of the camera 150.

This autofocus feature allows users who do not wear glasses to see the outside environment clearly without glasses.

The nose cover 140 is provided at the lower center of the glass faceplate 130.

The nose cover 140 functions to prevent water from entering the user's nose.

The camera 150 is installed on top of the glass faceplate 130.

The camera 150 functions to capture and image what is in front of the glass faceplate 130.

The images captured by the camera 150 are output to the glass faceplate 130 by means of the projector 170.

The radar 160 is disposed on one side of the camera 150 on top of the glass faceplate 130, side by side with the camera 150.

The radar 160 functions to scan and image the terrain in front of the glass faceplate 130 by using lasers, sound waves, etc.

The projector 170 is installed inside the mask part body 110. In this case, the projector 170 may be installed on the inside of the left or right side of the mask part body 110, or on both the inside of the left and right sides.

The projector 170 functions to output images captured by the camera 150 or an image scanned by the radar 160 to the inner surface of the glass faceplate 130.

As the projector 170 outputs the images or the image, information about the foreground and terrain in front of the glass faceplate 130 may be displayed on the glass faceplate 130.

As above, the glass faceplate 130 may function as a head-up display (HUD) in which images captured by the camera 150 or an image scanned by the radar 160 is displayed by the projector 170. Thus, in the following description, the HUD may be understood as the glass faceplate 130 through which image information is output by the projector 170.

The LED light 180 is provided on each of the left and right sides of the mask part body 110.

The LED light 180 functions to secure visibility in a dark underwater environment by emitting light.

The wearable part 200 is worn on the user's waist or arm and functions to supply power to the mask part 100 or control devices of the mask part 100.

The wearable part 200 may include a wearable part body 210 worn on the user's waist or arm; a fastening part 220 that fastens the wearable part body 210; the battery 230 that is provided on the wearable part body 210 and supplies power to the mask part 100 through the cable 300; and the controller 240 that controls the camera 150, the radar 160, the LED light 180, and the projector 170.

The wearable part body 210 is provided in a belt shape. In this case, the belt-shaped wearable part body 210 may be configured as a belt and worn around the user's waist, or may be configured as a bracelet and worn on the user's arm.

The fastening part 220 is provided at each end of the wearable part body 210 and functions to connect opposite ends of the wearable part body 210 to each other. As the opposite ends of the wearable part body 210 are fastened by the fastening part 220, the wearable part body 210 may be worn on the user's waist or arm.

The battery 230 is provided in the fastening part 220. In this case, a plurality of batteries 230 may be provided along the perimeter of the fastening part 220.

The batteries 230 may supply power to the mask part 100 through the cable 300.

The power supplied through the batteries 230 is supplied to the camera 150, the radar 160, the LED light 180, and the projector 170, so that the camera 150, the radar 160, the LED light 180, and the projector 170 may operate.

The controller 240 is provided in the fastening part 220.

The controller 240 may control the operation of the camera 150, the radar 160, the LED light 180, and the projector 170.

The controller 240 may receive images captured by the camera 150, correct the received images, and transmit the corrected images to the projector 170. Accordingly, the images captured by the camera 150 may be output to the glass faceplate 130.

The controller 240 may receive an image scanned by the radar 160, correct the received image, and transmit the corrected image to the projector 170. Accordingly, the image scanned by the radar 160 may be output to the glass faceplate 130.

When vision is blurry due to deep water or floating objects in the water, etc., the controller 240 may control the lighting intensity of the LED light 180, correct the images captured by the camera 150, correct the image scanned by the radar 160, and then provide the corrected images and image to the glass faceplate 130 by means of the projector 170.

The corrected images may be seen to some extent because of the LED light 180, which allows the user to move even in a turbid environment.

In addition, through the image scanned by the radar 160, reefs and obstacles may be identified, and by outputting this scanned image on the glass faceplate 130, the user may be prevented from hitting a reef.

The surrounding environments are captured in real time by the camera 150, and the controller 240 may obtain information on the captured images by comparing the captured images with data information previously stored in the controller 240. The information obtained may be the names and characteristics of reefs or underwater life.

For example, when a shark is around the user, and the camera 150 captures the shark, the controller 240 sends the shark's name and characteristics to the projector 170 by utilizing data information previously stored in the controller 240, and the projector 170 may output this received information to the glass faceplate 130 to warn the user. That is, the controller 240 may determine whether the underwater life captured by the camera 150 is dangerous on the basis of the data information previously stored in the controller 240 and inform the user of this through the glass faceplate 130 and the projector 170, that is, the HUD.

The wearable device 10 for scuba diving of the present disclosure may further include a communication device (not shown) provided on the mask part 100 or the wearable part 200 for wireless communication with a ship 20 or other users 30.

When the communication device is provided on the mask part 100, it is the mask part communication device 190, which will be described later, and when the communication device is provided on the wearable part 200, it is the wearable part communication device 250, which will be described later.

The wearable part 200 may further include the controller 240 that outputs a warning signal to the glass faceplate 130 by means of the projector 170 when the distance from the ship 20 or other users 30 increases.

The mask part 100 may further include the mask part communication device 190, and the wearable part 200 may further include the wearable part communication device 250.

The mask part communication device 190 is connected to the camera 150, the radar 160, the projector 170, and the LED light 180, whereas the wearable part communication device 250 is connected to the controller 240.

The mask part communication device 190 and the wearable part communication device 250 may be wirelessly connected to each other using Bluetooth or the like.

The mask part communication device 190 and the wearable part communication device 250 are connected to the plurality of batteries 230 and receive power from the plurality of batteries 230.

An electrical signal from the controller 240 may be transmitted to the camera 150, the radar 160, the projector 170, and the LED light 180 through the mask part communication device 190 and the wearable part communication device 250. Due to this, the controller 240 may easily control the camera 150, the radar 160, the projector 170, and the LED light 180.

For example, the controller 240 may measure brightness underwater, etc. on the basis of images of the surrounding environment captured by the camera 150, and may secure the user's field of view by adjusting the brightness by adjusting the lighting intensity of the LED light 180.

In addition, the controller 240 may detect surrounding obstacles and dangerous creatures such as reefs and sharks through the camera 150 and the radar 160 and inform the user of this through the glass faceplate 130 and the projector 170, that is, the HUD, so that the user may safely scuba dive.

As shown in FIG. 3, at least one of the mask part communication device 190 and the wearable part communication device 250 may be wirelessly connected to at least one of the mask part communication device 190 and the wearable part communication device 250 of the wearable device 10 for scuba diving of another user 30. In addition, at least one of the mask part communication device 190 and the wearable part communication device 250 may be may be wirelessly connected to a first communication device 21 and/or a second communication device 22 of the ship 20.

When the user becomes distant from other users 30 or from the ship 20, the controller 240 may notify the user of this by outputting a warning signal by means of the glass faceplate 130 and the projector 170, that is, the HUD, through wireless communication of the mask part communication device 190 or the wearable part communication device 250.

The controller 240 may measure the distance between the ship 20 and the wearable device 10 for scuba diving by measuring the distance between the first communication device 21, the second communication device 22, and the wearable device 10 for scuba diving by a triangulation method using wireless communication. Thus, the distance between the user and the ship 20 may be measured even underwater, where GPS is not possible.

In addition, by measuring the distance between the ship 20 and other users 30 by the triangulation method in the same manner as above and reflecting this distance, the distance between another user 30 and the user wearing the wearable device 10 for scuba diving may also be measured. Thus, the distance between the user wearing the wearable device 10 for scuba diving and another user 30 may be measured even underwater, where GPS is not possible.

In addition, by utilizing an underwater map pre-stored in the controller 240, images captured by the camera 150, and an image scanned by the radar 160, the controller 240 may implement a virtual map of the user's surrounding environment in real time, and output this map to the user by means of the glass faceplate 130 and the projector 170, that is, the HUD.

The controller 240 may calculate locations of the ship 20 and other users 30 using the above-described triangulation method, and display the locations of the ship 20 and other users 30 in real time on the virtual map, that is, the mini-map 132.

As above, as the controller 240 informs the user of the user's current location, etc., it is possible to prevent an accident from occurring due to the user moving away from the ship.

The wearable device 10 for scuba diving may further include an oxygen tank 400 and a sensor part (not shown).

The sensor part (not shown) may include an oxygen sensor (not shown) that checks the remaining amount of oxygen in the oxygen tank 400; a position sensor (not shown) that measures the user's diving depth; a temperature sensor (not shown) that measures the water temperature; and a timer (not shown) that measures the diving time. The sensor part is connected to the controller 240, and the control of the controller 240 is performed based on the information measured by the sensor part.

The mask part 100 may further include a humidity sensor (not shown) that measures water flowing into the interior of the glass faceplate 130.

The wearable part 200 may further include a floating part 260 provided on the wearable part body 210 to control buoyancy, and the controller 240 that increases the buoyancy of the floating part 260 to elevate the user out of the water when water is measured to flow into the interior of the glass faceplate 130 by the humidity sensor.

A plurality of floating parts 260 may be provided.

When water is measured to flow into the interior of the glass faceplate 130 by the humidity sensor, the controller 240 operates a navigation system that outputs the optimal route to a ship connected by wireless communication to the glass faceplate 130 by means of the projector 170.

The wearable part 200 may further include the floating part 260 provided on the wearable part body 210.

The floating part 260 controls buoyancy, and increases buoyancy when an emergency occurs, such as hitting a hazardous object or having no oxygen remaining, and the user must urgently get to the surface, thereby enabling the user to rise to the surface of the water.

The buoyancy of the floating part 260 is variable under the control of the controller 240.

For example, when the remaining oxygen level checked by the oxygen sensor falls below a preset value or when a collision occurs on a reef, the controller 240 operates the floating part 260 to increase buoyancy, thereby allowing the user to rise out of the water. In this case, the controller 240 may control the user's ascent speed by controlling the buoyancy of the floating part 260 to prevent the user from getting decompression sickness. That is, the controller 240 may control the user's ascent speed by controlling the buoyancy of the floating part 260 in consideration of the rate of change in water depth at which the user rises to the surface by means of the position sensor.

The controller 240 may operate a navigation system that displays the user's movement path by means of the virtual map created based on images captured by the camera 150 and an image scanned by the radar 160, and the glass faceplate 130 and the projector 170, that is, the HUD.

The mask part 100 may further include the humidity sensor. To be specific, the humidity sensor may be installed inside the mask part body 110 so as to be located inside the glass faceplate 130 of the mask part 100.

When the glass faceplate 130 is broken and water flows into the interior of the glass faceplate 130, the humidity sensor may measure the water or moisture flowing into the interior of the glass faceplate 130 and send a signal to the controller 240. When water is measured to flow into the glass faceplate 130, the controller 240 operates the floating part 260 to increase buoyancy, thereby raising the user out of the water. In addition, the controller 240 may operate the navigation system by outputting the optimal route to the ship connected through wireless communication to the glass faceplate 130 and the projector 170, that is, the HUD.

The cable 300 connects the mask part 100 and the wearable part 200, and functions to supply power to the mask part 100 by connecting the plurality of batteries 230 and the mask part 100.

The cable 300 includes not only a power line through which power is supplied, but also a communication line that transmits electrical signals from the controller 240 to the camera 150, the projector 170, the radar 160, the LED light 180, and the humidity sensor. In this case, the mask part 100 and the wearable part 200 may transmit and receive electrical signals by wire using the cable 300 rather than transmitting and receiving electrical signals wirelessly.

Unlike above, in the wearable device 10 for scuba diving, the mask part 100 and the wearable part 200 may be connected such that power is supplied wirelessly.

In other words, the batteries 230 of the wearable part 200 may wirelessly supply power to the mask part 100.

The wearable part 200 may further include an ultrasonic transmitter 251 connected to the batteries 230 and transmitting power via ultrasonic waves.

The ultrasonic transmitter 251 may be provided on the wearable part body 210.

The mask part 100 may further include an ultrasonic receiver 191 that receives power transmitted via ultrasonic waves from the ultrasonic transmitter 251.

The ultrasonic receiver 191 may be provided on the mask part body 110.

As above, the ultrasonic receiver 191 may receive power converted into ultrasonic waves from the ultrasonic transmitter 251 and supply power to the mask part 100.

In this way, the wearable device 10 for scuba diving may wirelessly supply power from the wearable part 200 to the mask part 100 even underwater, as power is supplied in the form of ultrasonic waves.

The oxygen tank 400 may further include a cable fixing part (not shown).

The cable fixing part functions to fix the cable 300. Therefore, it is possible to prevent the cable 300 from becoming tangled or disturbed when the user swims underwater.

The mask part 100 may further include: the gravity sensor 111 provided on the mask part body 110; the acceleration sensor 112 provided on the mask part body 110; the gyro sensor 113 provided on the mask part body 110; and the geomagnetic field sensor 114 provided on the mask part body 110.

The gravity sensor 111 functions to detect the direction of gravity.

The controller 240 may calculate the up and down directions underwater based on the direction of gravity measured by the gravity sensor 111.

The projector 170 may output the up and down directions underwater calculated by the controller 240 to the glass faceplate 130 through the 3D direction chart 131 as shown in FIG. 4.

The acceleration sensor 112 functions to measure acceleration by detecting changes in the speed indicated by the mask part 100.

The controller 240 may measure the user's underwater speed wearing the wearable device 10 for scuba diving on the basis of the acceleration indicated by the mask part 100 measured by the acceleration sensor 112.

The gyro sensor 113 functions to recognize the tilt of the mask part 100 by detecting the rotation state of the mask part 100 in three axes.

The geomagnetic field sensor 114 functions to measure the geomagnetic field.

The controller 240 may calculate the user's orientation underwater, that is, the east, west, south, and north directions, on the basis of the geomagnetic field measured by the geomagnetic field sensor 114.

The projector 170 may output the calculated underwater direction to the glass faceplate 130.

The controller 240 may recognize six-axis directions by inputting rotation to acceleration by means of the acceleration sensor 112 and the gyro sensor 113.

The controller 240 may measure the real-time location of the user wearing the wearable device 10 for scuba diving on the basis of the location of the user wearing the wearable device 10 for scuba diving calculated through the above-described triangulation, and of changes in the user's speed and six-axis directions.

The controller 240 may calculate the user's location underwater on the basis of data measured by the acceleration sensor 112 and the gyro sensor 113 and transmit the calculated user's location to the projector 170. As shown in FIG. 4, by means of the mini-map 132, the projector 170 may output the user's location underwater calculated by the controller 240 to the glass faceplate 130.

In addition, the controller 240 may calculate the user's orientation underwater on the basis of the geomagnetic field measured by the geomagnetic field sensor 114 and transmit the calculated user's orientation to the projector 170. As shown in FIG. 4, by means of the 3D direction chart 131, the projector 170 may output the user's orientation underwater calculated by the controller 240 to the glass faceplate 130.

The wearable device 10 for scuba diving of the present disclosure described above has the advantage of reducing the weight and volume of the mask part 100 by providing the plurality of batteries 230 and the controller 240 in the wearable part 200 rather than the mask part 100. Accordingly, when swimming underwater, it is possible to prevent the user's swimming from being interrupted by the mask part 100 being heavy and bulky.

The wearable device 10 for scuba diving of the present disclosure may easily determine the real-time location and orientation of the user wearing the wearable device 10 for scuba diving, and up and down directions underwater by means of the gravity sensor 111, the acceleration sensor 112, the gyro sensor 113, the geomagnetic field sensor 114, and the HUD provided in the mask part 100. Accordingly, it is possible to prevent accidents from occurring due to users losing direction in water where it is easy to lose direction.

Furthermore, since the sensors are attached to the mask part 100 worn on the user's head, the measured values of the sensors may be easily matched to values in the same direction as the user's field of view. Thus, user's orientation, location, etc. may be calculated using the measured values of the sensors without any additional correction.

Although preferred embodiments of the present disclosure have been disclosed for illustrative purposes, those skilled in the art will appreciate that various modifications, additions, and substitutions are possible, without departing from the scope and spirit of the present disclosure.

DESCRIPTION OF REFERENCE NUMERALS

10: wearable device for scuba diving
100: mask part 110: mask part body
120: hair band 130: glass faceplate
131: 3D direction chart 132: mini-map
140: nose cover 150: camera
160: radar 170: projector
180: LED light 190: mask part communication device
200: wearable part 210: wearable part body
220: fastening part 230: battery
240: controller 250: wearable part communication device
260: floating part
300: cable
400: oxygen tank

The invention claimed is:

1. A wearable device for scuba diving, the device comprising:
a mask part worn on a user's head; and
a wearable part configured to supply power to the mask part; and
a cable connecting the wearable part and the mask part,
wherein the mask part comprises:
a mask part body;
a glass faceplate provided at a front of the mask part body; and
humidity sensor that measures an inflow of water or moisture into an interior of the glass faceplate,
wherein the wearable part comprises:
a wearable part body; and
a floating part provided on the wearable part body to control buoyancy; and
a controller configured to control the floating part,
wherein the cable transmits and receives electrical signals from the controller to the humidity sensor, and the controller increases the buoyancy of the floating part to lift the user out of the water when the humidity sensor detects that water has entered the interior of the glass faceplate.

2. The device of claim 1, further comprising an oxygen tank having a cable holder configured to secure the cable.

3. The device of claim 1, wherein the wearable part further comprises batteries provided in the wearable part body and supplying power to the mask part,
wherein the wearable part body is formed in a belt shape to be worn around the user's waist,
both ends of the wearable part body are provided with a fastening part to couple and connect both ends,
the batteries are provided along a circumference of the wearable part body, and the cable supplies power from the batteries to the mask part.

4. The device of claim 1, wherein the mask part further comprises:
a camera configured to capture underwater environments;
a projector installed inside the mask part body to output images or image to the glass faceplate; and
a radar installed on top of the glass faceplate,
wherein the cable transmits and receives electrical signals from the controller to the camera, the projector and the radar, and the projector outputs images captured by the camera or an image scanned by the radar to the glass faceplate.

5. The device of claim 4, wherein the controller receives images captured by the camera or the image scanned by the radar through the cable, corrects the images or the image, and transmit the corrected images or image to the projector through the cable.

6. The device of claim 1, wherein the mask part further comprises an LED light provided on each side of the mask part body, and the cable transmits and receives electrical signals from the controller to the LED lights.

7. The device of claim 1, wherein the mask part further comprises:

a camera configured to capture underwater environments; and a projector installed inside the mask part body to output images or image to the glass faceplate, and wherein the controller operates a navigation system that outputs an optimal route to a ship connected by wireless communication to the glass faceplate by means of the projector when the humidity sensor detects that water has entered the interior of the glass faceplate.

8. The device of claim 1, further comprising:

a communication device provided in the mask part or the wearable part to communicate wirelessly with a ship or another user, wherein the mask part further comprises:

a camera configured to capture underwater environments; and a projector installed inside the mask part body to output images or image to the glass faceplate, and wherein the controller outputs a warning signal to the glass faceplate by means of the projector when a distance from the ship or another user increases.

9. The device of claim 1, wherein the mask part further comprises:

a camera configured to capture underwater environments;

a projector installed inside the mask part body to output images or image to the glass faceplate; and a gravity sensor provided on the mask part body to detect a direction of gravity, wherein the controller calculates up and down directions underwater based on the direction of gravity measured by the gravity sensor, and the projector outputs the calculated up and down directions underwater to the glass faceplate.

10. The device of claim 9, wherein the mask part further comprises a geomagnetic field sensor that is provided on the mask part body and measures geomagnetic field, wherein the controller calculates a user's orientation underwater on the basis of the geomagnetic field measured by the geomagnetic field sensor, and the projector outputs the calculated user's orientation underwater to the glass faceplate.

11. The device of claim 1, wherein the mask part further comprises:

a camera configured to capture underwater environments;

a projector installed inside the mask part body to output images or image to the glass faceplate;

an acceleration sensor provided on the mask part body to detect changes in speed indicated by the mask part; and a gyro sensor provided on the mask part body to recognize a tilt of the mask part, wherein the controller calculates a user's location underwater on the basis of data obtained by the acceleration sensor and the gyro sensor and transmits the calculated user's location to the projector, and the projector outputs the calculated user's location underwater to the glass faceplate.

* * * * *